US006047648A

United States Patent [19]

Alm et al.

[11] Patent Number: 6,047,648

[45] Date of Patent: Apr. 11, 2000

[54] FITTING AS WELL AS TABLE AND TABLE SYSTEM WITH SUCH

[75] Inventors: Karl-Erik Alm, Trelleborg; Ruud Ekstrand, Malmö, both of Sweden

[73] Assignee: Inredningsform Gunnar Ottosson AB, Malmo, Sweden

[21] Appl. No.: 09/288,653

[22] Filed: Apr. 9, 1999

Related U.S. Application Data

[63] Continuation of application No. PCT/SE97/01695, Oct. 10, 1997.

[30] Foreign Application Priority Data

Oct. 11, 1996 [SE] Sweden ..... 9602723

[51] Int. Cl.[7] ..... A47B 3/06

[52] U.S. Cl. ..... 108/157.16; 108/64; 248/188.1

[58] Field of Search ..... 108/157.16, 158.11, 108/153.1, 156, 157.1, 64; 248/188.1, 188

[56] References Cited

U.S. PATENT DOCUMENTS

| | | | |
|---|---|---|---|
| 795,957 | 8/1905 | Cartland | 108/157.16 X |
| 1,448,642 | 3/1923 | Tomlinson | 108/157.16 |
| 2,943,897 | 7/1960 | Johnson et al. . | |
| 3,915,100 | 10/1975 | Sullivan . | |
| 3,966,340 | 6/1976 | Morris | 108/156 X |
| 4,187,786 | 2/1980 | Feig et al. . | |
| 4,409,906 | 10/1983 | Alneng . | |
| 4,665,836 | 5/1987 | Burr . | |
| 4,826,343 | 5/1989 | Richards | 108/156 X |
| 5,035,186 | 7/1991 | Uredat et al. | 108/64 X |
| 5,182,996 | 2/1993 | Gutgsell . | |
| 5,341,749 | 8/1994 | Noakes . | |
| 5,435,254 | 7/1995 | Amey et al. | 108/64 |
| 5,483,900 | 1/1996 | Elzenbeck | 108/64 |
| 5,528,996 | 6/1996 | Edwards et al. | 108/64 |
| 5,718,179 | 2/1998 | Johnson et al. | 108/153.1 X |
| 5,934,203 | 8/1999 | Glass | 108/156 |
| 5,934,204 | 8/1999 | Oberle | 108/157.16 X |

FOREIGN PATENT DOCUMENTS

| | | |
|---|---|---|
| 0 476 315A1 | 3/1992 | European Pat. Off. . |
| 770609 | 9/1934 | France . |
| 1200640 | 12/1959 | France . |
| 1467964 | 2/1967 | France . |
| 1554264 | 5/1970 | Germany . |
| 329 524 | 10/1970 | Sweden . |
| 445 945 | 7/1986 | Sweden . |
| 273054 | 6/1927 | United Kingdom . |

*Primary Examiner*—Jose V. Chen
*Attorney, Agent, or Firm*—Finnegan, Henderson, Farabow, Garrett & Dunner, L.L.P.

[57] ABSTRACT

An assembly fitting for coupling a table leg to a table top comprises on the one hand a leg attachment (20) for attaching to a table leg (A) and, on the other hand, a table top attachment (10) for attaching to a table top (B). A bayonet coupling (10, 20) is arranged between the table top attachment (10) and the leg attachment (20) and is lockable by means of a plate (22), which projects laterally from the table leg (A), in one or more turning positions for positioning the table leg (A) in relation to the table top (B). The plate (22) has a shape such that it projects beyond the table top (B) in at least one of the lockable turning positions of the bayonet coupling (10, 20). In a table, the table top (B) and the table legs (A) are connected to each other with the aid of such assembly fittings. In a table system with table legs (A) and two or more table tops (B, B'), the table legs (A) are connected to the table tops (B, B') with the aid of such assembly fittings in such a manner that a plate (22) of an assembly fitting, in a joint of two table tops (B, B'), supports and is connected to the two table tops (B, B').

14 Claims, 4 Drawing Sheets

FITTING AS WELL AS TABLE AND TABLE SYSTEM WITH SUCH

This application is a continuation of International Application No. PCT/SE97/01695, filed Oct. 10, 1997, the content of which is incorporated herein by reference.

FIELD OF THE INVENTION

The present invention generally relates to the coupling of table parts, and more particularly the invention relates to an assembly fitting for coupling a table leg to a table top. The fitting according to the invention is also usable for coupling together two tables. Moreover, the invention relates to a table and a table system with table tops, table legs and fittings as stated above.

BACKGROUND OF THE INVENTION

In meeting-places, such as conference rooms and restaurants, the number of visitors may vary considerably from one time to another. Consequently, the number of tables required will also vary. Accordingly, before a meeting, tables which will not be needed must be taken to a storage room or the like or, alternatively, tables which are needed must be brought from the storage room to the meeting-room. In the case of tables with fixed legs, the tables must be stacked on top of each other both when being stored and when being transported. This is complicated, and, in addition, the stacked-up tables take up a great deal of space. It is true that folding tables take up only a small amount of storage space, but, on the other hand, folding and unfolding them is often a complicated and time-consuming operation. Moreover, when unfolded, such tables are often unstable and rickety.

According to another common construction, the table leg has a threaded end and the table top has a corresponding threaded receiving means, so that the leg can be screwed to the table top. While it is true that such tables can be disassembled for storage and transportation, they also have the drawback that the table legs must have a circular cross-section, since the table legs cannot be positioned in a defined turning position when being fitted to the table top.

In the meeting-place, the tables are subsequently placed in different formations depending upon the number of seats required on each occasion. On such occasions, when the tables are placed in a row, double table legs are obtained where two tables abut. These double legs take up a great deal of space and are inconvenient for the individuals who are seated where the tables abut.

A prior art table system, disclosed in U.S. Pat. No. 5,341,749, consists of mounting plates, which are fitted to the corners of a number of table tops, and a number of supports each fixedly connected to a respective table leg. Four supports are rotatably attached by means of one screw each to one mounting plate each in a first table top. In a first application position, the table legs are turned in under the first table top and are fixed in a mounting plate by means of screws, enabling the table to stand on four legs in the normal manner. In a second application position, the table legs and the associated supports are turned out from the table top and thereby form contact surfaces for further table tops, which are fixed to the supports of the table legs by means of screws. In this way, the occurrence of double legs where two tables abut is eliminated.

SE-B-445,945 describes a device, which enables several table tops to be joined by means of a fitting formed by two disc-shaped pieces, which is fastened around projections in each table top and which bridges the joint of these table tops. A leg shared by the adjoining table tops can subsequently be attached to this fitting be means of a bayonet grip. The detachment of the leg is simple, but in order to the disassemble the table tops it is necessary to loosen and detach the disc-shaped parts of the fitting.

A drawback of the above construction is that several screws are required for attaching a table leg to a table top by the intermediary of the support. The large number of screws makes the assembly operation more difficult and also increases the likelihood of a screw being lost after a certain period of use. In addition, in the known construction, each table leg must make a turning movement when two table tops are to be assembled. This turning movement can be made more difficult by friction between the end surface of the table leg and the floor surface, e.g. a wall-to-wall carpet. Furthermore, it is not possible to join these tables in more than one way. For example, tables cannot easily be coupled together at an angle to each other with this prior art construction.

SE-B-329,524 shows a framework, whose tube-shaped means are joined with the aid of connecting pieces. Upon insertion of the end portions of the connecting pieces into the tube-shaped means, a support plate can be slipped over the end portions and be fastened between the end of the tube-shaped means and the connecting piece. This support plate can then serve as a supporting surface for e.g. a shelf. The support plate can be used in different directions to permit e.g. a shelf to be supported on an optional side of the tubes of the framework.

EP-A-0 476 315 shows a table construction, in which a coupling member is attached-to the upper end of the legs to permit a table top to be supported or to support two or four table tops placed next to each other. The coupling member has four holes for mounting pins placed in a square, making it possible to fit the leg so that it rests completely inside the edge of a table top, or half-way underneath two adjoining table tops, or so that it extends under the corners of four table tops placed adjacent to each other.

FR-A-1,200,640 shows the use of bayonet grips for joining framework components and fastening shelves or plates between adjoining leg parts.

FR-A-1,467,964 shows a table construction, in which one half of a bayonet grip is fitted to the top end of a leg and the other half is attached to the underside of the table top. Consequently, the legs can be easily attached or detached, but the construction is such that the components attached to the table top project from the underside of the table top and therefore make it difficult to stack individual table tops on top of each other. There is no possibility of connecting adjoining table tops to each other.

SUMMARY OF THE INVENTION

In light of the above, it is an object of the present invention to provide a fitting which, when used in a table system, permits the quick and easy assembly and disassembly of the same. Another object is to permit space-saving storage and transportation of such a table system.

It is also an object to provide a fitting which results in a stable coupling between a table leg and a table top, which can be placed as close as possible to the outer edge of the table top, and which allows the cross-sectional shape of the table legs to be quadrangular.

A further object is to minimise the number of components included in the fitting.

It is also an object to provide a fitting, which, when used in a table system, minimises the number of table legs in order to provide as much space as possible for the users, and which, more particularly, eliminates the occurrence of double table legs where two table tops abut.

A further object is to provide a fitting which permits the quick and stable coupling of adjoining table tops.

In addition, it is desirable to be able to use the fitting to easily connect table tops and table leg so that both longitudinal and angled table formations can be formed.

These and other objects, which can be seen from the description below, have now been completely or partially achieved by an assembly fitting, a table, and a table system according to the appended claims 1, 11 and 12. Preferred embodiments are stated in the subclaims.

To sum up, the invention relates to an assembly fitting intended for a table or a table system, a table equipped with such assembly fittings, and a table system with such assembly fittings. The assembly fitting has a leg attachment and a table attachment for attaching to a table leg and a table top, respectively. Both attachments are connectable to each other with the aid of a bayonet coupling, whose sleeve part is formed in the table top attachment and whose insertion part is formed in the leg attachment. The leg attachment has a plate projecting laterally from the leg attachment and the table leg. The bayonet coupling is lockable in at least two turning positions for positioning the projecting plate (22) in relation to the table top. Depending upon the locking position chosen for the bayonet coupling, this plate sits completely under the table top or projects beyond the edge of table top. When this fitting is used for a single table top, the leg and the leg attachment are fitted to the table top attachment (10) so that the projecting plate sits underneath the table top. If two or more adjoining table tops are to be connected to each other, the bayonet coupling is locked in a position such that the plate bridges the joint of two adjoining table tops in order to connect them to each other.

An advantage of an assembly fitting according to the invention is that table legs and table tops equipped with the fitting can be stored and transported individually and subsequently be assembled quickly and easily when needed by virtue of the bayonet coupling.

In addition, by virtue of the bayonet coupling, the table leg can be locked in a predetermined turning position in relation to the table top. As a result, it is possible to ensure that, for instance, a table leg with a quadrangular cross-section has an attractive and defined position in relation to a quadrangular table top.

The bayonet coupling in combination with a support, which is connected to the table leg and projects from the same, make it possible to connect two table tops and a table leg in such a way that the table leg is placed close to the joint of two connected table tops and as a result supports them in a stable manner.

By virtue of the employment of a bayonet coupling, the table leg can be rotated around its longitudinal symmetry axis and consequently does not need to perform a pivot motion when two table tops are being connected. The combination of a support and a bayonet coupling also makes it possible for the table to stand alone or to be easily and stably connected to other table tops to make up both longitudinal and angular formations.

BRIEF DESCRIPTION OF THE DRAWINGS

The invention and its advantages will be described in more detail below with reference to the accompanying drawings, which by way of example show a presently preferred embodiment.

DESCRIPTION OF A PREFERRED EMBODIMENT

Figure 1A:
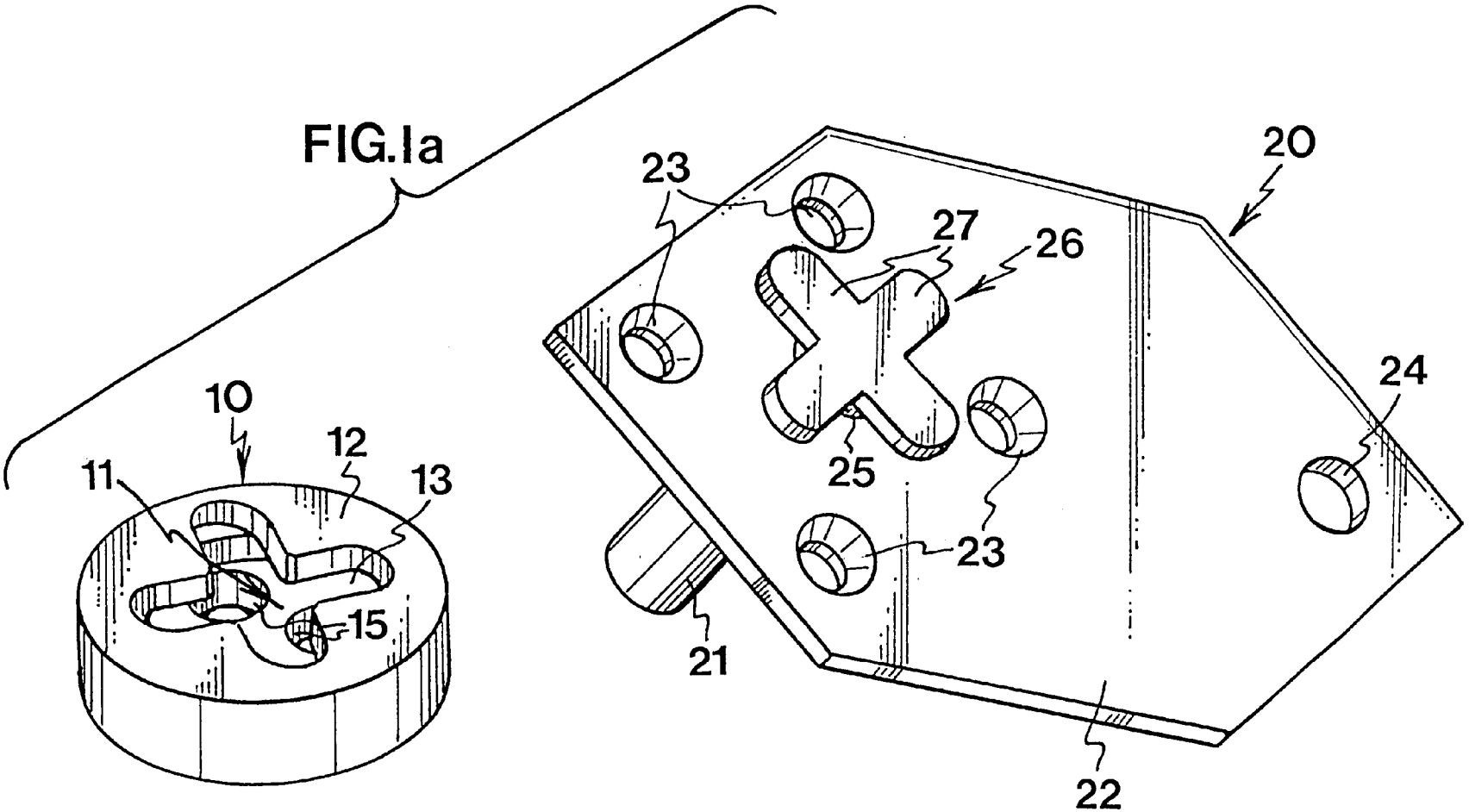
FIGS. 1*a* and 1*b* are perspective views of a fitting according to the invention with a sleeve part and an insertion part.
Figure 1B:
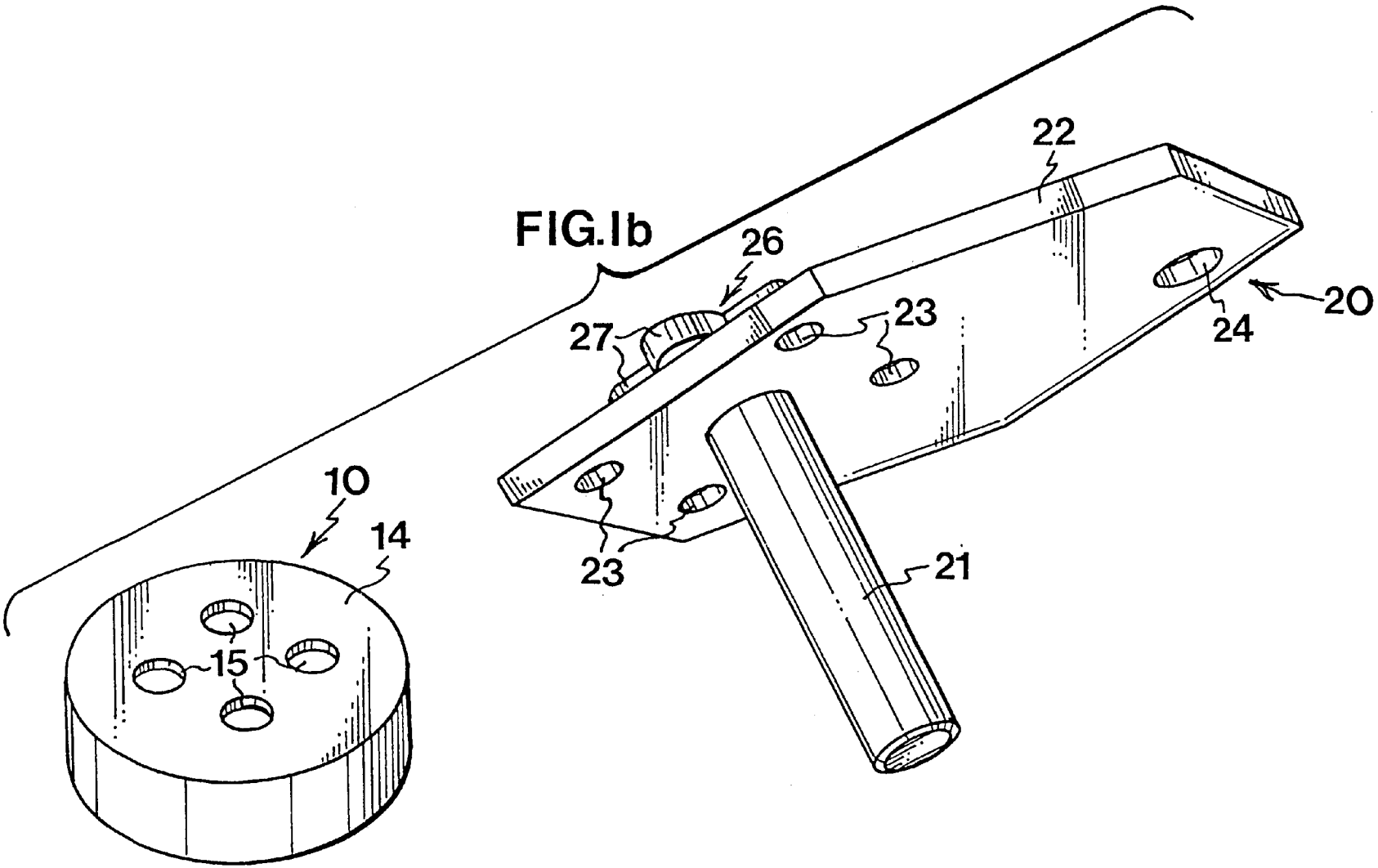

A fitting according to the invention can be seen in FIGS. 1*a* and 1*b*. The fitting comprises a cylindrical sleeve part 10, preferably made of metal, in which a cavity 11 is formed. This cavity is preferably essentially cylindrical. One end surface 12 of the sleeve part 10 has an opening 13, which communicates with the cavity 11 and is formed as two slots, which intersect at right angles and consequently form a cross-shaped opening 13 with four uniformly distributed opening branches. In the opposite end surface 14 of the sleeve part 10, recesses 15 are formed for receiving fastening means (not shown), such as screws, for attaching the sleeve part 10 in an indentation close to an edge of a table top, preferably in a corner of the table top. The recesses 15 are preferably located directly opposite the branches of the opening 13 so that a tool, such as a screwdriver, can be inserted into the opening 13 for attaching the sleeve part 10 to the table top.

The fitting additionally comprises an insertion part 20, preferably made of natal, to be received by the sleeve part 10. The insertion part 20 has a guide pin 21 which is adapted to extend down into the upper part of a table leg. The guide pin 21 is connected to a supporting plate 22, which has a number of recesses 23 for receiving fastening means (not shown), such as screws, for attaching the insertion part 20 to one end surface of the table leg. The supporting plate 22 is elongated and in one end exhibits a fixing recess 24, whose function will be described in connection with FIGS. 2–3. A projection 25 is formed in the other end of the supporting plate 22 and extends in the extension of the guide pin 21. In the end portion which is spaced apart from the supporting plate 22, the projection 25 supports an engagement means 26 in the shape of four tongues 27, which are uniformly distributed circumferentially and which project perpendicularly from the projection 25. As a result, the engagement means 26 and the opening 13 have matching shapes. In terms of size, the engagement means 26 is somewhat smaller than the opening 13, which means that the engagement means 26 is insertable into the cavity 11 by the intermediary of the opening 13, which cavity preferably is formed so that the engagement means 26 is rotatable over a whole revolution therein.

The sleeve part 10 and the insertion part 20 of the fitting are adapted to each other so that they function as a bayonet coupling subsequent to the insertion of the engagement means 26 into the cavity 11. By rotating the insertion part 20 through 45° in relation to the sleeve part 10, a frictional engagement is achieved between these two. The distance between the tongues 27 and the supporting plate 22 is adjusted in relation to the wall thickness of the opening-containing end surface 12 of the sleeve part 10 so that frictional engagements are obtained between those surfaces of the tongues 27 which are facing the supporting plate 22 and those surface portions of the cavity 11 which are located between the branches of the opening. The fitting illustrated thus has four angular positions with frictional engagement, corresponding to a 45°, a 135°, a 225°, and a 315° rotation after the insertion of the insertion part 20 into the sleeve part 10.

Figure 2:
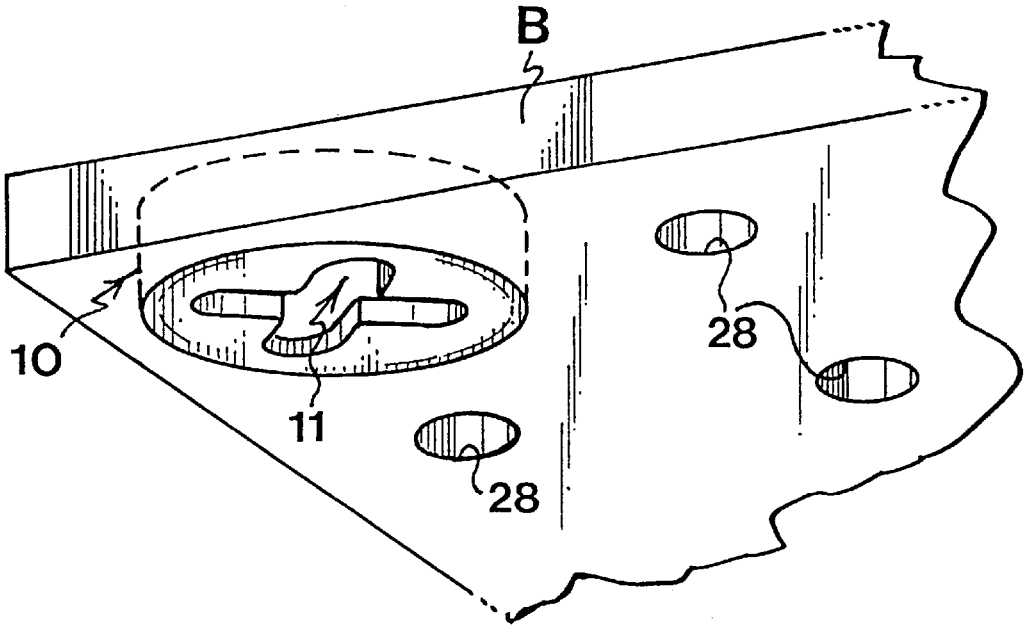
FIG. 2 is a view of a fitting according to the invention, where, the sleeve part is attached to a table top and the insertion part is attached to a table leg.
Figure 2:
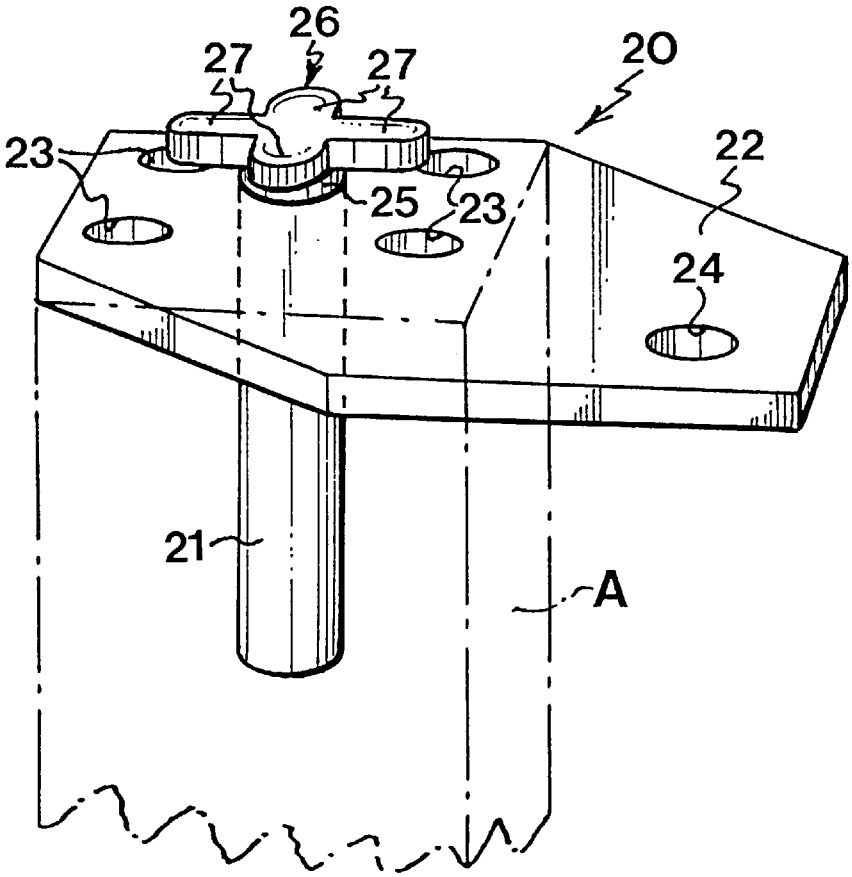

The use of the fitting according to the invention for coupling a table leg to a table top will be described below with reference to FIGS. 2–3. FIG. 2 shows a fitting attached to a table leg and a table top, and FIG. 3 shows three of the lockable turning positions of the fitting.

The insertion part 20, which is fixedly connected to a table leg A with the aid of fastening members, in this case screws 29, is inserted into the sleeve-part 10, which by means of fastening members 30, in the form of screws in this case as well, is non-rotatably arranged in an indentation in a table top B. Subsequently, the user rotates the table leg A around its symmetry axis until the table leg A and the supporting plate 22, which projects essentially perpendicularly from the table leg A, have a desired orientation relative to the table top B. By virtue of the above-mentioned angular positions with frictional engagement between the parts 11, 26 of the bayonet coupling, the user can find the desired turning position among a number of predetermined turning positions, in this case four.

Figure 3:
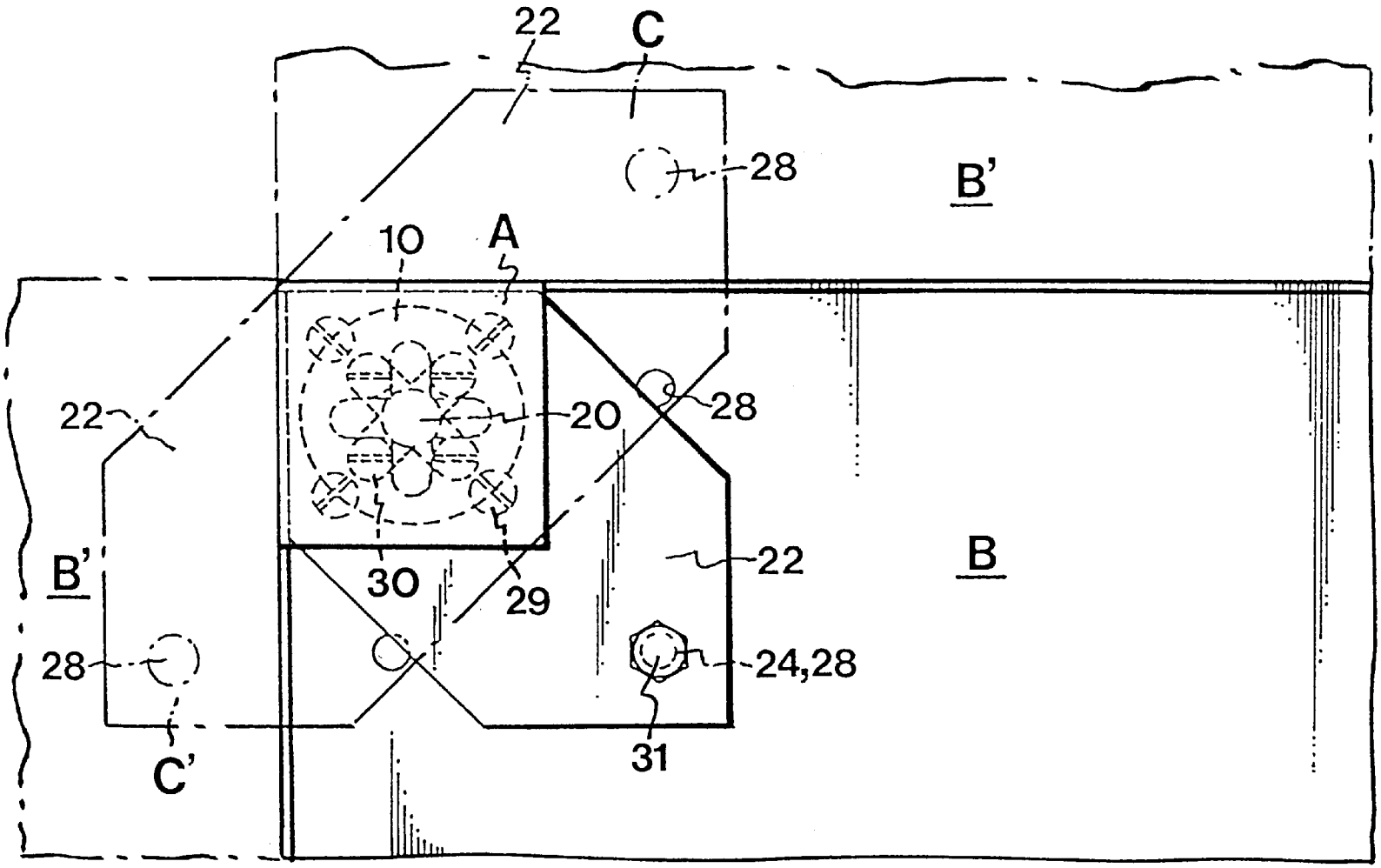
FIG. 3 is a plan view of a part of a table system seen from below after the coupling of a table leg to one or two table tops and shows three of the lockable turning positions of the fitting.

If the table is to stand alone, the user finds a turning position, which is indicated by full lines in FIG. 3 and in which the supporting plate 22 projects under the table top B. In this turning position, in which one large face of the supporting plate 22 is arranged against the table top B, the table leg A is subsequently locked in relation to the table top B by the user arranging a fastening member 31, such as a screw, to extend through the fixing recess 24 of the supporting plate 22 and into a receiving means 28, such as a threaded insert non-rotatably arranged in the table top B.

If tables are to be placed in a certain formation, the user finds a different turning position, in which the supporting plate 22 projects beyond the table top B. Two such turning positions C, C' are indicated by dot-dash, lines in FIG. 3. Subsequently, a second table top B' is placed on that portion of the supporting plate 22 which projects from the table top B. In this turning position, the table leg A is subsequently looked in the manner described above by the user arranging a fastening means to extend through the fixing recess 24 of the supporting plate 22 into a receiving means 28 of the adjoining, second table top B'. In this way, both a turning position fixing of the table leg A in relation to the table top B and a coupling of the two table tops B, B' to each other are obtained in a single operation.

It will be appreciated that other types of bayonet couplings can be used in a fitting according to the invention. However, it is preferred that the engagement means 26 of the insertion part 20, which in intended for insertion into the sleeve part 10, have a non-circular shape. The cross-shaped engagement means 26 in coaction with a cavity 11 of a sleeve part 10 as stated above has the advantage that four mutually perpendicular turning positions with frictional engagement can be obtained. This means that a table leg A with a quadrangular cross-section can be exactly positioned in relation to a table top B. In addition, the four tongues 27 of the engagement means 26 provide a stable coupling with a frictional engagement uniformly distributed circumferentially.

When the fitting is to function as an assembly fitting for connecting table tops it is particularly advantageous if the engagement means 26 is rotatable through 360° within the cavity 11 of the sleeve part 10 and is formed with at least three-phase rotation symmetry, and preferably four-phase rotation symmetry, since this makes it easy for the user to find a turning position with a frictional engagement, in which both the table leg A and the supporting plate 22 have the desired orientation in relation to the table top B.

Moreover, it should be pointed out that the above-mentioned locking of the turning positions of the bayonet coupling can be effected in alternative ways within the scope of the invention. For example, spring-biased pins can be arranged in the table top, which pins are intended to snap into the fixing recess 24 of the supporting plate 22 and which in that case replace the screws 31. In this case, the above-mentioned angular positions with frictional engagement of the bayonet coupling can be dispensed with since the supporting plate 22 is looked automatically when its recess 24 is rotated directly opposite said pin. However, the locking of the turning position according to the embodiment illustrated is preferred by virtue of its simplicity and stability and it can simultaneously provide both the locking of the turning position of the table leg A and the coupling of two table tops B, B'.

The engagement between the sleeve part 10 and the insertion part 20 can also be realized in other ways, for example by stops being formed in the cavity 11, and the engagement means 26 being moved to abut against or engage with these stops.

As can be seen from the drawings, the centre of rotation of the bayonet coupling is eccentrically located on the plate 22, so that the latter can be placed completely inside the edges of a table top or be placed so that it projects from the edge or edges of the table top. In the preferred shape of the assembly fitting shown in the drawings, the plate 22 has a hexagonal shape and the centre of rotation of the bayonet coupling 11, 26 is located eccentrically on the plate approximately at the centre of a connecting line between two corners. It is preferable for the plate 22 to be given an elongated shape by two opposite edges of the plate 22 having a greater length than the other edges, the centre of rotation of the bayonet coupling 11, 26 being located on a connecting line between one end of the long edges.

Other shapes of the projecting plate are possible, however, as long as the plate can be optionally placed completely inside the edges of the table top or projecting from the edge of the table top by the selection of a mounting position for the bayonet coupling.

What is claimed is:

1. An assembly fitting for fastening a top end of a table leg to a table top, comprising a leg attachment fixable to the top end of the table leg, a table top attachment, and a bayonet coupling for connecting the leg attachment and the table top attachment, the bayonet coupling having a sleeve part formed in the table top attachment, an insertion part formed in the leg attachment, and a center of rotation on which the leg attachment is turnable relative to the table top attachment to at least two locking positions, and a plate projecting laterally from the leg attachment in an angular location related to the locking positions, so that when the assembly fitting is used to fasten the top end of a table leg to a table top, the plate projecting laterally from the leg attachment is located either completely under the table top or projecting beyond the edge of the table top, depending upon the one of the at least two locking positions chosen for the bayonet coupling.

2. An assembly fitting according to claim 1, wherein the center of rotation of the bayonet coupling substantially coincides with a center of the top of a table leg to which the leg attachment is fixable.

3. An assembly fitting according to claim 1, wherein the projecting plate has a recess for receiving fastening means for locking the plate and the bayonet coupling in a chosen one of the at least two locking positions.

4. An assembly fitting according to claim 1, wherein the bayonet coupling has engagement parts formed for reciprocal frictional engagement in angular positions corresponding to the at least two locking positions.

5. An assembly fitting according to claim 4, wherein said angular positions substantially coincide with the respective locking positions.

6. An assembly fitting according to claim 1, wherein the bayonet coupling has at least three locking positions.

7. An assembly fitting according to claim 6, wherein the locking positions of the bayonet coupling are substantially perpendicular to each other.

8. An assembly fitting according to claim 1, wherein the insertion part of the bayonet coupling has an engagement member with a non-circular shape.

9. An assembly fitting according to claim 8, wherein the engagement member has at least three projecting tongues.

10. An assembly fitting according to claim 1, wherein the projecting plate has a shape such that it projects beyond the table top in at least one of the at least two locking positions of the bayonet coupling.

11. An assembly fitting according to claim 10, wherein the plate is hexagonal and the center of rotation of the bayonet coupling is located eccentrically on the plate approximately at the center of a connecting line between two corners.

12. An assembly fitting according to claim 11, wherein two opposite edges of the plate have a greater length than the other edges, and that the center of rotation of the bayonet coupling is located on a connecting line between one end of the long edges.

13. A table comprising a table top, table legs, and an assembly fitting for fastening a top end of each of the table legs to the table top, the assembly fitting including a leg attachment fixable to the top end of each table leg, a table top attachment recessed in the table top adjacent to an edge thereof, and a bayonet coupling for connecting the leg attachment and the table top attachment, the bayonet coupling having a sleeve part formed in the table top attachment, an insertion part formed in the leg attachment, and a center of rotation on which the leg attachment is turnable relative to the table top attachment to at least two locking positions, and a plate projecting laterally from the leg attachment in an angular location related to the locking positions, so that the plate projecting laterally from the leg attachment is located either completely under the table top or projecting beyond the edge of the table top, depending upon the one of the at least two locking positions chosen for the bayonet coupling.

14. A table system comprising two or more table tops placed next to each other and supported on the top ends of table legs through an assembly fitting for fastening a top end of each of the table legs to the table tops, the assembly fitting including a leg attachment fixable to the top end of each table leg, a table top attachment recessed in the table tops adjacent to edges thereof, and a bayonet coupling for connecting the leg attachment and the table top attachment, the bayonet coupling having a sleeve part formed in the table top attachment, an insertion part formed in the leg attachment, and a center of rotation on which the leg attachment is turnable relative to the table top attachment to at least two locking positions, and a plate projecting laterally from the leg attachment in an angular location related to the locking positions, the plate projecting laterally from the leg attachment bridging a joint of adjoining table tops and being connected thereto.

* * * * *

UNITED STATES PATENT AND TRADEMARK OFFICE

CERTIFICATE OF CORRECTION

PATENT NO. : 6,047,648
DATED : April 11, 2000
INVENTOR(S) : Karl-Erik ALM et al.

It is certified that error appears in the above-identified patent and that said Letters Patent is hereby corrected as shown below:

Title Page, Item [30], in the Foreign Application Priority Data, "9602723" should read --9603723-9--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*